US008918920B2

(12) United States Patent
Jourde et al.

(10) Patent No.: US 8,918,920 B2
(45) Date of Patent: Dec. 30, 2014

(54) SOFT CHEST PROTECTOR

(75) Inventors: Bastien Jourde, Montreal (CA); Bill Best, Orono, MN (US)

(73) Assignee: Shock Doctor, Inc., Minnetonka, MN (US)

( * ) Notice: Subject to any disclaimer, the term of this patent is extended or adjusted under 35 U.S.C. 154(b) by 11 days.

(21) Appl. No.: 13/016,414

(22) Filed: Jan. 28, 2011

(65) Prior Publication Data

US 2011/0307999 A1 Dec. 22, 2011

Related U.S. Application Data

(60) Provisional application No. 61/299,756, filed on Jan. 29, 2010.

(51) Int. Cl.

| | |
|---|---|
| ***A63B 71/12*** | (2006.01) |
| *A41D 13/05* | (2006.01) |
| *A41D 13/015* | (2006.01) |

(52) U.S. Cl.

CPC ..... *A63B 71/12* (2013.01); *A41D 13/0531* (2013.01); *A41D 13/0512* (2013.01); *A41D 13/0518* (2013.01); *A63B 71/1291* (2013.01); *A41D 13/0153* (2013.01); *A63B 2071/1208* (2013.01)

USPC ..... 2/462; 2/463

(58) Field of Classification Search

USPC ..... 2/459–465, 467, 468, 44, 45

See application file for complete search history.

(56) References Cited

U.S. PATENT DOCUMENTS

| | | | | |
|---|---|---|---|---|
| 2,163,463 | A | | 6/1939 | Kennedy |
| 3,900,896 | A | | 8/1975 | Ackerman |
| 4,338,685 | A | | 7/1982 | LaPorta, Jr. |
| 4,383,523 | A | | 5/1983 | Schurman |
| D277,236 | S | | 1/1985 | Gregory |
| 4,501,023 | A | | 2/1985 | Bilberry |
| 4,516,273 | A | * | 5/1985 | Gregory et al. ..... 2/462 |
| 4,590,622 | A | | 5/1986 | Wolfe et al. |
| 4,628,913 | A | | 12/1986 | Lerman |
| 4,694,505 | A | * | 9/1987 | Flosi et al. ..... 2/462 |
| D296,595 | S | | 7/1988 | Flosi et al. |
| D300,376 | S | * | 3/1989 | Tellini ..... D29/101.3 |
| 4,993,076 | A | * | 2/1991 | Dierickx ..... 2/463 |
| 5,029,341 | A | | 7/1991 | Wingo, Jr. |
| 5,060,313 | A | | 10/1991 | Neuhalfen |

(Continued)

FOREIGN PATENT DOCUMENTS

| | | | |
|---|---|---|---|
| WO | WO2008050303 | A2 | 5/2008 |
| WO | WO2009109941 | A1 | 9/2009 |
| WO | WO2011034942 | A1 | 3/2011 |

OTHER PUBLICATIONS

International Search Report and Written Opinion issued in PCT/US2010/048959, mailed Nov. 15, 2010, 13 pages.

(Continued)

*Primary Examiner* — Khoa Huynh
*Assistant Examiner* — Andrew W Collins
(74) *Attorney, Agent, or Firm* — Faegre Baker Daniels LLP

(57) ABSTRACT

An impact protection device may include a front protective assembly and a rear protective assembly. The front protective assembly and/or the rear protective assembly may include protective pads that can be removed in order to better accommodate a neck brace. The protective pads may be left in place when no neck brace is being used.

21 Claims, 7 Drawing Sheets

(56) References Cited

U.S. PATENT DOCUMENTS

| | | | | |
|---|---|---|---|---|
| 5,065,457 | A | 11/1991 | Henson | |
| 5,159,715 | A | 11/1992 | Jurga et al. | |
| 5,483,698 | A * | 1/1996 | Douglas, Jr. | 2/462 |
| 5,531,669 | A | 7/1996 | Varnau | |
| 5,546,601 | A | 8/1996 | Abeyta | |
| 5,623,728 | A * | 4/1997 | Wagner | 2/462 |
| 5,652,967 | A * | 8/1997 | Hsu | 2/463 |
| 5,768,717 | A * | 6/1998 | Le Sueur | 2/467 |
| 6,067,665 | A | 5/2000 | DePalma et al. | |
| 6,267,741 | B1 | 7/2001 | Lerman | |
| D484,648 | S | 12/2003 | Fiorini et al. | |
| 6,678,899 | B2 * | 1/2004 | Fiorini et al. | 2/463 |
| D494,323 | S | 8/2004 | Weller | |
| 6,775,851 | B1 | 8/2004 | Chen et al. | |
| 6,826,786 | B2 | 12/2004 | Fiorini et al. | |
| 6,971,123 | B2 | 12/2005 | Weaver | |
| 6,991,343 | B2 * | 1/2006 | Langley et al. | 362/108 |
| 7,065,800 | B2 * | 6/2006 | Brown | 2/463 |
| D600,860 | S | 9/2009 | Durham | |
| 7,647,651 | B2 | 1/2010 | Contant et al. | |
| 7,827,625 | B2 | 11/2010 | Morrow et al. | |
| 7,882,576 | B2 | 2/2011 | Morrow et al. | |
| 7,900,283 | B1 * | 3/2011 | Chen | 2/455 |
| D638,583 | S | 5/2011 | Bishop | |
| 7,975,321 | B1 | 7/2011 | Behrens | |
| D643,978 | S | 8/2011 | Alonso et al. | |
| 8,024,820 | B2 | 9/2011 | Weimer et al. | |
| D663,072 | S | 7/2012 | Best et al. | |
| D663,484 | S | 7/2012 | Best et al. | |
| D665,949 | S * | 8/2012 | Jourde et al. | D29/101.3 |
| 8,336,124 | B2 | 12/2012 | Crelinsten et al. | |
| 2002/0162162 | A1 * | 11/2002 | Collins et al. | 2/463 |
| 2003/0024035 | A1 * | 2/2003 | Fiorini et al. | 2/463 |
| 2006/0048292 | A1 * | 3/2006 | Gillen et al. | 2/456 |
| 2007/0010771 | A1 | 1/2007 | Leatt | |
| 2007/0199129 | A1 | 8/2007 | Davis | |
| 2008/0134419 | A1 * | 6/2008 | Kalaam et al. | 2/463 |
| 2008/0250552 | A1 * | 10/2008 | Durham | 2/456 |
| 2008/0313793 | A1 | 12/2008 | Skottheim et al. | |
| 2010/0088808 | A1 * | 4/2010 | Rietdyk et al. | 2/467 |
| 2010/0122404 | A1 * | 5/2010 | Bowlus et al. | 2/467 |
| 2010/0251468 | A1 * | 10/2010 | Mazzarolo | 2/468 |
| 2010/0263112 | A1 * | 10/2010 | Mazzarolo et al. | 2/468 |
| 2010/0306908 | A1 * | 12/2010 | Fiegener et al. | 2/463 |
| 2011/0010829 | A1 * | 1/2011 | Norman | 2/459 |
| 2011/0167548 | A1 | 7/2011 | Jourde et al. | |

OTHER PUBLICATIONS

International Search Report and Written Opinion issued in PCT/US2011/023019, mailed Jun. 9, 2011, 11 pages.

Design U.S. Appl. No. 29/383,774, filed Jan. 21, 2011, entitled Chest Protector.

Design U.S. Appl. No. 29/424,221, filed Jun. 8, 2012, entitled Chest Protector.

Design U.S. Appl. No. 29/424,223, filed Jun. 8, 2012, entitled Soft Chest Protector.

Design U.S. Appl. No. 29/396,572, filed Jul. 1, 2011, entitled Soft Chest Protector.

Design U.S. Appl. No. 29/398,483, filed Aug. 1, 2011, entitled Soft Chest Protector.

* cited by examiner

SOFT CHEST PROTECTOR

RELATED APPLICATION

This application claims the benefit of U.S. Ser. No. 61/299,756 filed Jan. 29, 2010 entitled "CHEST PROTECTOR AND UNDERGARMENT FOR A CHEST PROTECTOR," said application is incorporated by reference herein in its entirety.

TECHNICAL FIELD

Embodiments of the present invention generally relate to personal protective gear. In particular, various embodiments of the present invention relate to chest protectors.

BACKGROUND

Chest protectors are generally worn by motocross participants, "BMX" participants, participants in other active sports, as well as participants in contact sports such as football, hockey and lacrosse. Traditional chest protectors used for motocross are generally designed to protect the participant's chest, back, shoulders and clavicles from flying debris, from injury during a fall or a crash, contact with other participants, and the like.

Recently, new safety gear has been introduced to motocross and other active sports to better protect participants. One of the more significant safety devices that have been introduced in recent years are neck braces that protect the participant's head from high velocity forward movement (i.e. towards the chest) and rearward movement (i.e. towards the back), as these movements are a leading cause of spinal and head injuries. These neck braces include structure that extends downwardly from the neck along the upper chest and upper neck to support the neck and limit movement. Commercially available neck braces are sold, for example, by Alpinestars and Troy Lee Designs (under the brand name "LEATT").

Unfortunately, conventional chest protectors are not necessarily compatible with these neck braces. In particular, the use of conventional chest protectors in combination with these neck braces may cause the neck brace to not fit properly due to the positioning of structure extending from the neck brace relative to the chest and back shields included on many chest protectors, and/or due to the presence of clavicle or shoulder caps that interfere with structure on the neck brace that is intended to rest on the clavicle of the participant. This, in turn, may cause the neck brace to rest too high on the participant and/or cause the chest protector to fit improperly or uncomfortably in order to accommodate neck brace extensions.

As a result, participants have either opted not to wear either the chest protector or the neck brace, or have worn both in an ill-fitting manner. In either case, the safety and/or comfort of the participant may be impacted.

SUMMARY

Various embodiments of the present invention relate to chest protectors particularly for use in high-speed motor sports (e.g., motocross) or other activities to protect the participant from impact with other participants and/or objects.

In some embodiments, the present invention relates to an impact protection device that includes a front protective assembly and a rear protective assembly. The front protective assembly includes a shoulder region that is configured to extend over a wearer's clavicles or shoulders and a chest region that is configured to extend over the wearer's ribcage. The front protective assembly defines a chest pad receiving region that is disposed within the chest region. A chest pad is removably secured within the chest pad receiving region such that the chest pad can be removed to accommodate a neck brace having a front extension that fits into the chest pad receiving region. The chest pad can be kept in place within the chest pad receiving region when the wearer chooses not to use a neck brace.

In some embodiments, the present invention relates to an impact protection device that includes a front protective assembly and a rear protective assembly. The front protective assembly includes a shoulder region that is configured to extend over a wearer's clavicles or shoulders and a chest region that is configured to extend over the wearer's ribcage. The front protective assembly defines a chest pad receiving region disposed within the chest region. The rear protective assembly includes a spine pad receiving region. A chest pad is removably secured within the chest pad receiving region and a spine pad is removably secured within the spine pad receiving region.

The chest pad and the spine pad can be removed to accommodate a neck brace having a front extension that fits into the chest pad receiving region and a rear extension that fits into the spine pad receiving region.

In some embodiments, the present invention relates to an impact protection assembly that includes a front protective assembly, a rear protective assembly, one or more straps joining the front protective assembly to the rear protective assembly, and a neck brace. The front protective assembly includes a shoulder region that is configured to extend over a wearer's clavicles or shoulders and a chest region that is configured to extend over the wearer's ribcage. The front protective assembly defines a chest pad receiving region disposed within the chest region. The rear protective assembly includes a spine pad receiving region. The neck brace includes a front extension that fits into the chest pad receiving region and a rear extension that fits into the spine pad receiving region.

While multiple embodiments are disclosed, still other embodiments will become apparent to those skilled in the art from the following detailed description, which shows and describes illustrative embodiments. Accordingly, the drawings and detailed description are to be regarded as illustrative in nature and not restrictive.

Figure 2:
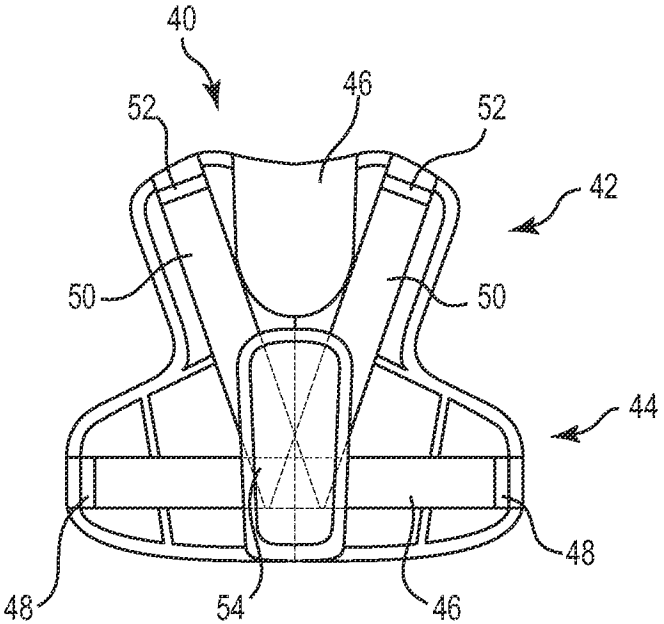
FIG. 2 illustrates a rear protective assembly that may be used in combination with the front protective assembly of FIG. 1 to form an impact protection device in accordance with embodiments of the present invention.

The drawings have not necessarily been drawn to scale. For example, the dimensions of some of the elements in the figures may be expanded or reduced to help improve the understanding of the embodiments of the present invention. Moreover, while the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as described herein.

DETAILED DESCRIPTION

In the following description, for the purposes of explanation, numerous specific details are set forth in order to provide a thorough understanding of embodiments of the present invention. It will be apparent, however, to one skilled in the art that embodiments of the present invention may be practiced without some of these specific details.

Various embodiments of the present invention generally relate to personal protective gear, such as chest protectors. As used herein, the term "chest protector" includes a device that when worn covers a portion of a torso of a user (not shown), including a front (anterior) and/or back (posterior) portion of the user. The torso of the user generally includes the upper body (e.g., neck, shoulders, chest, abdomen, upper back, and lower back. Though chest protectors generally are worn on the torso, chest protectors according to some embodiments also include extensions and/or other features for protecting the groin, buttocks, thighs, and/or other portions of users. In some uses, chest protectors are worn underneath clothing (e.g., a jersey or enduro jacket) or on top of clothing during motocross, or other high-speed motor sports to protect a rider from injury.

In some embodiments, a chest protector is made with dense foam that provides flexibility that facilitates movement of the user through a desired range of motion. In some embodiments, a chest protector may optionally include one or more hardened areas (e.g., portions formed of durable polycarbonate, plastics, nylon, or other materials formed by injection molding or other appropriate methodology) to protect the rider from impacts with the ground, flying debris, other riders, stationary objects (e.g., tree branches, barricades, rocks, etc). Additionally or alternatively, various portions of the chest protector are formed of dense foam. As subsequently described, in some embodiments, the chest protector is adapted to have auxiliary protection components added or removed from a base unit, the chest protector defining an assembly formed of multiple pieces that facilitate specialization for particular uses and/or according to user preferences.

In some embodiments, the chest protector includes multiple connection points that allow the user to add one or more removable protective attachments, also described as auxiliary protection components, to a chest protector, also described as an impact protection device. Examples of removable protective attachments include, but are not limited to, a heart guard, a neck brace, shoulder pads, shoulder caps, front clavicle caps, back clavicle caps, lower back pads, extended back sections, extended rib sections, floating bicep protectors, lower back sections, and others. In some cases, one or more of these protective attachments may be more permanently affixed (i.e., not intended to be removed by the user) while others are intended to be removable by the user.

In some embodiments, the chest protector or impact protection device is designed to allow for integration with various styles of neck braces to limit movement of the user's head. In some embodiments, and as will be described subsequently with respect to the Figures, the impact protection device may include a front protective assembly and/or a rear protective assembly that are configured to accommodate a neck brace. In some embodiments, the impact protection device may include removable pads that can be removed to provide the impact protection device with voids that are configured to accept front and/or rear extensions of a removable neck brace.

In some embodiments, a removable neck brace protects the user by limiting tilting movements of a helmeted head of the user in some directions (e.g., anterior-posterior and/or medial-lateral directions) or in all directions. Illustrative but non-limiting examples of suitable neck braces include those available from Leatt Corporation Inc., 26320 Diamond Place, Suite 130, Santa Clarita, Calif. 91350, as well as those described in U.S. Patent Publication No. 2007/0010771 to Leatt, which is incorporated by reference herein in its entirety.

In some embodiments, the neck brace is attached to the protective device using hook and loop fasteners, such as VELCRO®. In some embodiments, a loop strap with both sides made of the loop material of the fastener is attached to the neck brace or the protective device (e.g., on the harness or on a protective attachment). The loop strap is positioned between two fastener straps for a stronger connection than a single loop and single fastener.

Figure 1:
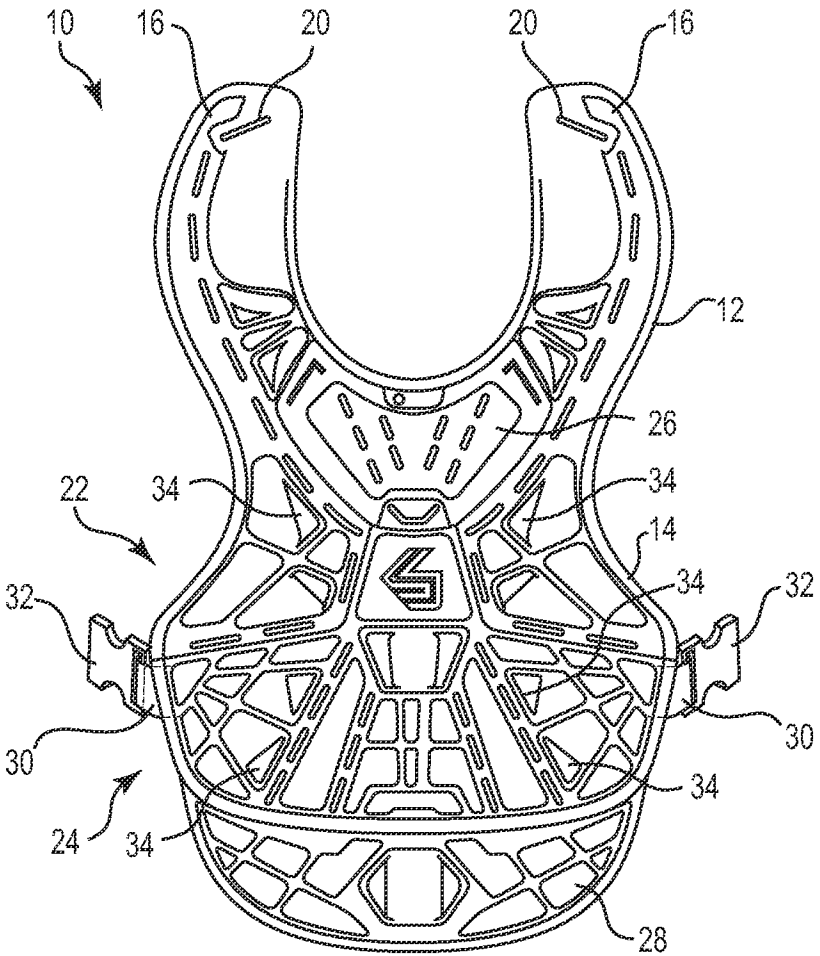
FIG. 1 illustrates a front protective assembly in accordance with embodiments of the present invention.

In some embodiments, an impact protection device may include a front protective assembly and a rear protective assembly that can be strapped or otherwise joined together to form the impact protection device. FIG. 1 illustrates a front protective assembly that may be used in combination with a rear protective assembly as shown in FIG. 2.

FIG. 1 is an illustration of a front protective assembly 10 in accordance with embodiments of the present invention. The front protective assembly 10 includes a shoulder region 12 and a chest region 14. It will be appreciated that in some embodiments, the shoulder region 12 is sized and configured to extend at least partially over the wearer's clavicles and/or shoulders. In some embodiments, as illustrated, the shoulder region 12 includes first and second extensions 16 that, in use, extend on either side of the wearer's neck. In some embodiments, as will be discussed further with respect to FIGS. 9 and 10, the first and second extensions 18 may include slots 20 that are sized and configured to accommodate straps that help secure the front protective assembly 10 to a rear protective assembly (not shown in FIG. 1). In some embodiments, the first and second extensions 18 may be configured to permit removable attachment of additional components such as shoulder extensions and/or biceps pads.

The chest region 14 may be sized and configured to extend at least partially about the wearer's ribcage. In some embodiments, the chest region 14 may be considered to include an upper portion 22 and a lower portion 24. A removable chest pad 26 may be disposed within the upper portion 22. As will be discussed subsequently, if a neck brace such as a LEATT® brace is being used in combination with the impact protection device, the chest pad 26 may be removed to accommodate a front extension of the neck brace.

In some embodiments, an abdominal pad 28 may be releasably secured to the lower portion 24 of the chest region 14. In some embodiments, the chest region 14 may include one or more strap sections 30 and corresponding buckles 32 that may be used to help secure the front protective assembly 10 to a rear protective assembly.

In some embodiments, the front protective assembly 10 may be patterned to permit air circulation. For example, the front protective assembly 10 may be formed from an air-permeable base fabric layer and a patterned foam secured to the base fabric layer. In some embodiments, the patterned foam is the outermost layer of the front protective assembly 10. In some embodiments, the patterned foam may include raised or compressed portions that augment the appearance of the front protective assembly 10. The patterned foam may include apertures 34 that extend through the foam and thus permit air to flow through the protective front assembly 10 in order to cool the wearer. While a particular pattern is shown, it will be appreciated by those of skill in the art that a variety of different patterns, with differing shapes and perhaps changes in void space relative to non-void space may be selected. Adding additional voids, for example, may enhance flexibility and air circulation while including fewer voids may enhance impact resistance.

FIG. 2 is an illustration of a rear protective assembly 40 in accordance with embodiments of the present invention. The rear protective assembly 40 may be considered to include an upper portion 42 and a lower portion 44. In some embodiments, the rear protective assembly 40 helps to protect the wearer's back and kidneys from fall-related impacts. In some embodiments, the rear protective assembly 40, in combination with one or more straps, helps to locate and secure the front protective assembly 10 in position relative to the wearer.

In some embodiments, the rear protective assembly 40 includes a spine pad receiving region 46. In some embodiments, particularly if no neck brace is being worn, the spine pad receiving region 46 may be considered as being sized and configured to releasably secure a spine pad or other protective pad. If a neck brace such as a LEATT® brace is being used in combination with the impact protection device, the spine pad receiving region 46 may be considered as being sized and configured to accommodate a rear extension of the neck brace.

In some embodiments, one or more straps may be used to secure the rear protective assembly 40 relative to the front protective assembly 10. In some embodiments, as illustrated, the lower portion 44 of the rear protective assembly 40 is configured to accommodate one or more straps that extend from the lower region 24 of the front protective assembly 10 and thus extend at least partially about the wearer's midsection. The lower portion 44 may include a strap track 46. In some embodiments, the strap track 46 is sized to accommodate a strap but does not anchor the strap. In some embodiments, a strap may be permanently secured to the strap track 46. In some embodiments, a strap may be secured to the strap track 46 by passing through one or more slots 48 that are formed at either end of the strap track 46.

In some embodiments, the upper portion 42 of the rear protective assembly 40 may be configured to accommodate one or more straps that extend from the shoulder region 12 of the front protective assembly 10 and thus extend at least partially over the wearer's shoulders. The upper portion 42 may include one or more strap tracks 50. In some embodiments, the strap tracks 50 are sized to accommodate one or more straps but do not anchor the straps. In some embodiments, the straps may be secured to the strap tracks 50 by passing through one or more slots 52 that are formed at an upper end of each of the strap tracks 50. In some embodiments, at least one end of the one or more straps may be permanently attached at an anchor location 54. In some embodiments, as will be illustrated with respect to FIG. 10, straps may extend along the strap tracks 50 from the anchor location 54, loop through the slots 20 that are formed within the extensions 16 of the shoulder region 12 and then fasten back to themselves via hook and loop fasteners.

Figure 3:
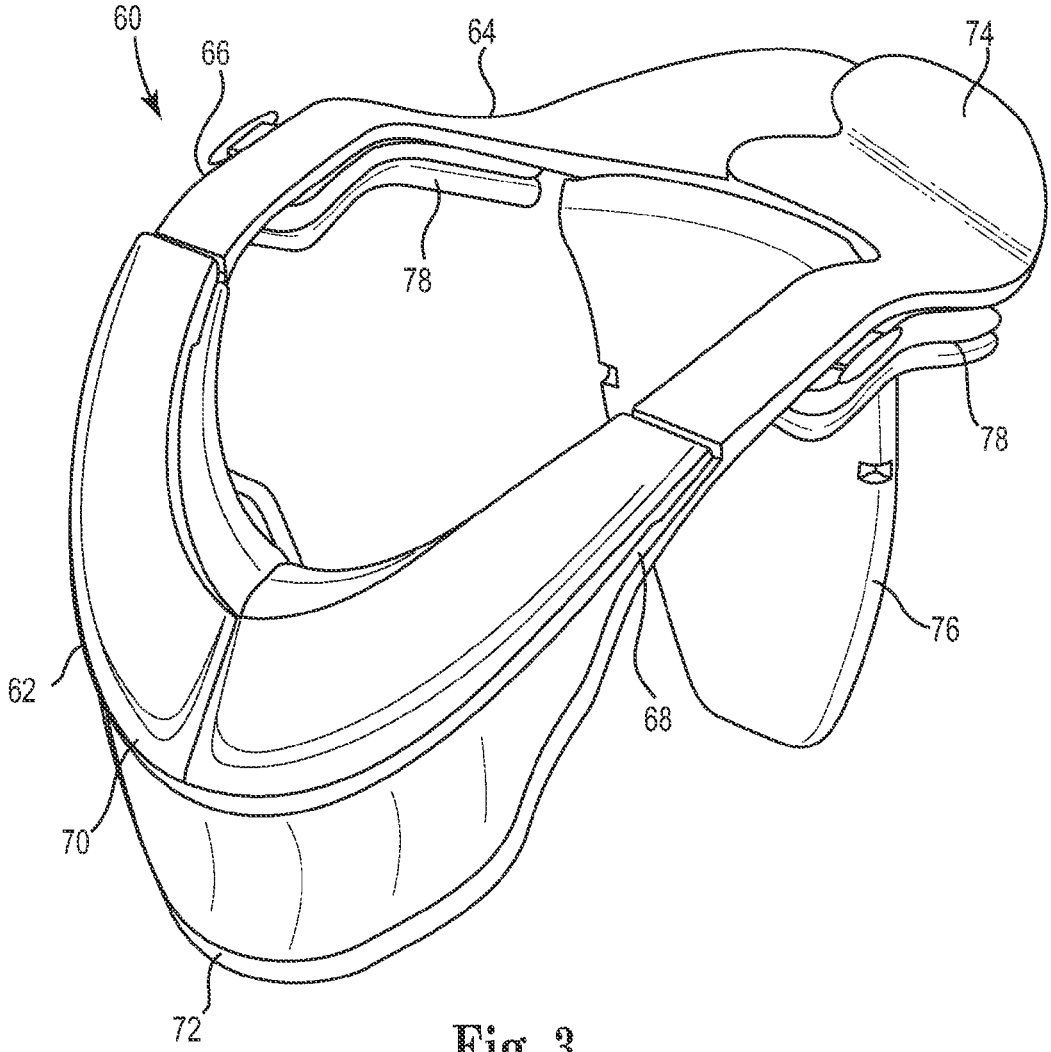
FIG. 3 illustrates a neck brace that may be used with an impact protection device in accordance with embodiments of the present invention.

FIG. 3 illustrates a neck brace 60 that may be used in conjunction with various embodiments of the impact protection device described herein. Commercially available versions of such neck braces are available from Troy Lee Designs (the "LEATT") and AlpineStars, amongst others. Although different versions of such neck braces 60 are available, each have similar features including a front section 62, a rear section 64 and clavicle sections 66, 68 that connect the front and rear sections 62, 64. In various versions, the front section 62 further includes an upper flange 70 and a lower flange or front extension 72. The rear section 64 includes an upper flange 74 and lower extension 76. The clavicle sections 66, 68 each include a support 78 in the illustrated embodiment.

Figure 4:
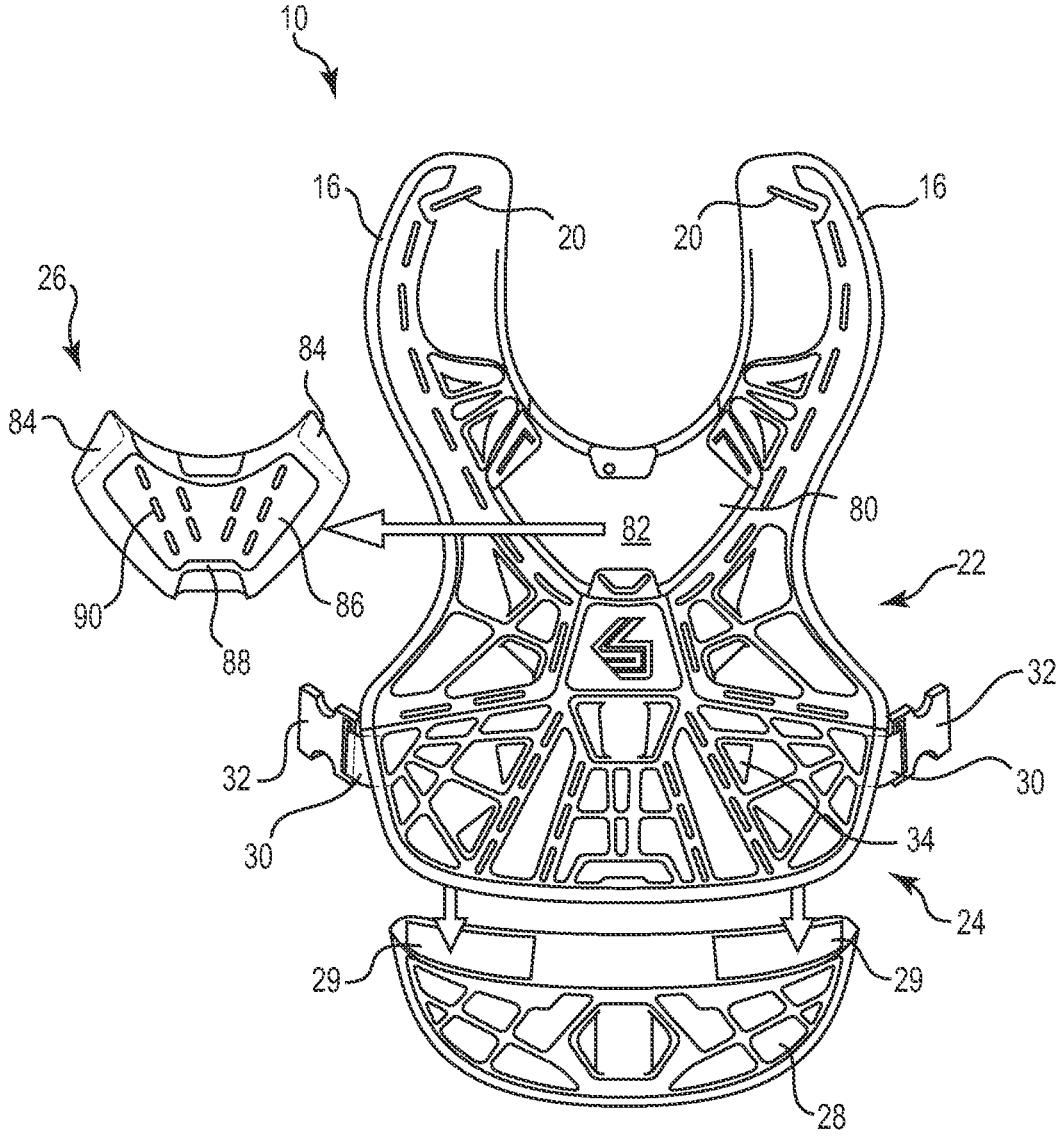
FIG. 4 illustrates the individual components of the front protective assembly of FIG. 1.

FIGS. 4 through 8 illustrate how the chest pad 26 (FIG. 1) and a spine pad may be removed to accommodate the front and rear extensions of a neck brace such as the neck brace 60 (FIG. 3). In FIG. 4, for example, the chest pad 26 has been removed to reveal a chest pad receiving region 80. In some embodiments, the chest pad receiving region 80 may have a mesh or otherwise breathable bottom 82. The bottom 82 may be a continuation of the air-permeable base fabric layer that extends under the patterned foam discussed above.

The chest pad 26 may include fastener regions 84 that are configured to releasably secure the chest pad 26 to the chest pad receiving region 80. In some embodiments, the fastener regions 84 may include one half of a hook-and-loop fastener system such as that commercially available under the VELCRO® name. In such a case, the chest pad receiving region 80 may include sections of the corresponding hook or loop portion of the hook-and-loop fastener system. In some embodiments, it is contemplated that the fastener regions 84 may fasten directly to the bottom 82 of the chest pad receiving region 80. In some embodiments, the chest pad 26 may include a patterned foam layer 86 atop a breathable base layer 88. In some embodiments, as illustrated, the patterned foam layer 86 may include voids or apertures 90 that permit air to flow through the chest pad 26 and thus help cool the wearer.

In some embodiments, as shown for example in FIG. 4, the abdominal pad 28 may also be attached to the lower region 24 of the front protective assembly 10 via a hook-and-loop fastener system 29. In some embodiments, it is contemplated that the abdominal pad 28 could instead be an integral part of the front protective assembly 10.

Figure 6:
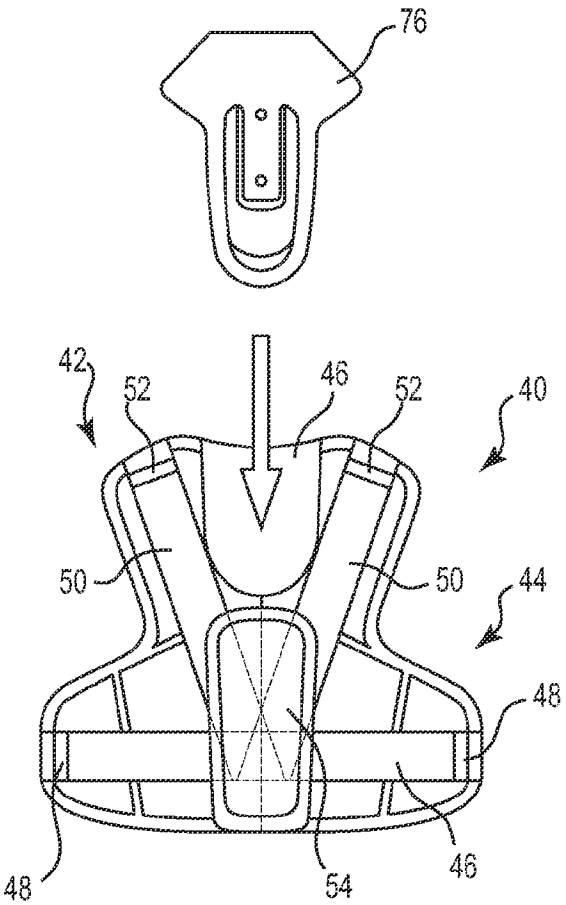
FIG. 6 illustrates how the rear protective assembly interacts with a rear extension of a neck brace in accordance with embodiments of the present invention.
Figure 5:
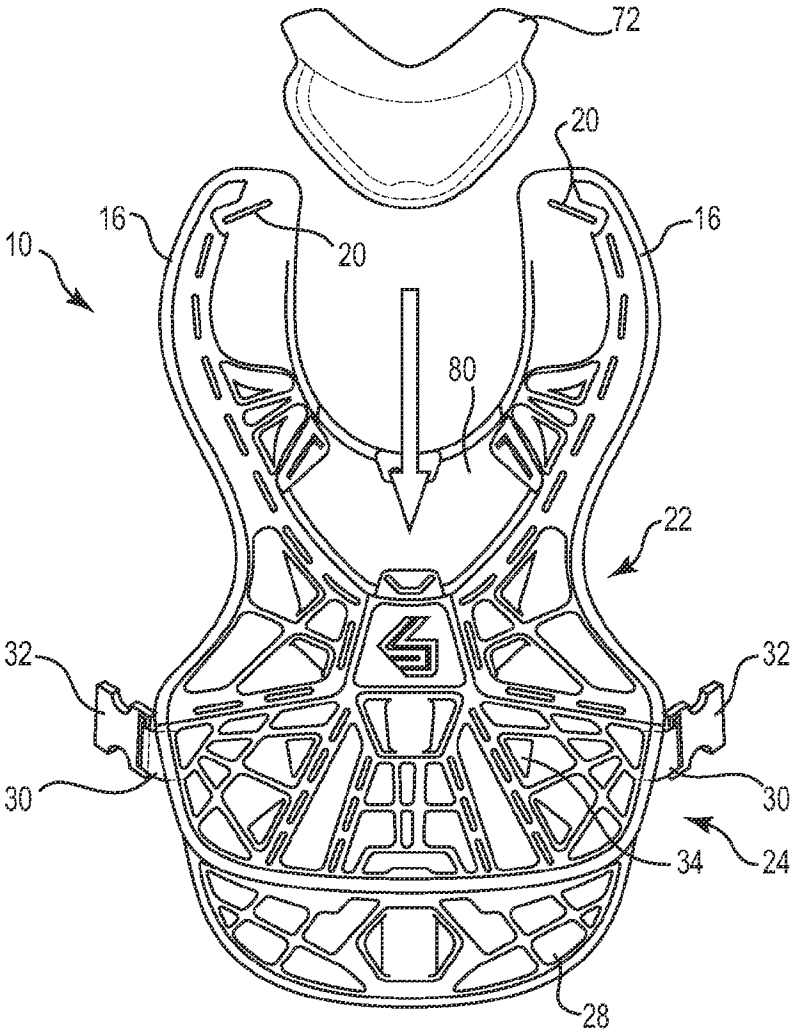
FIG. 5 illustrates how the front protective assembly interacts with a front extension of a neck brace in accordance with embodiments of the present invention.
Figure 8:
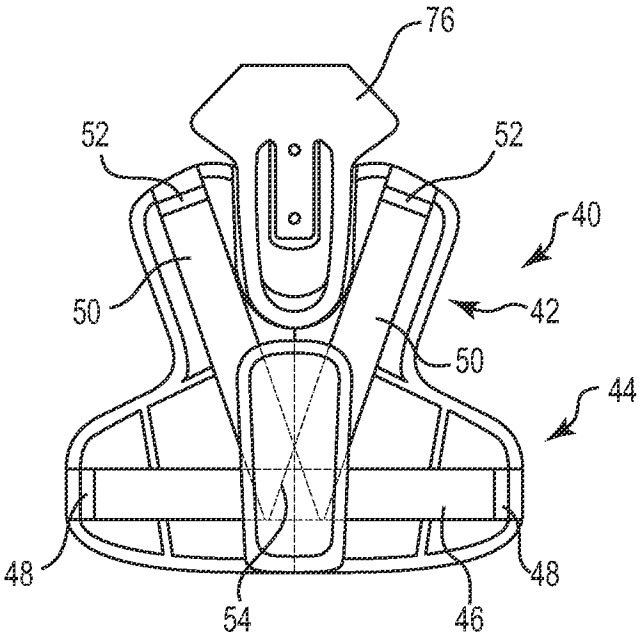
FIG. 8 illustrates the rear extension of a neck brace engaged in the rear protective assembly in accordance with embodiments of the present invention.
Figure 7:
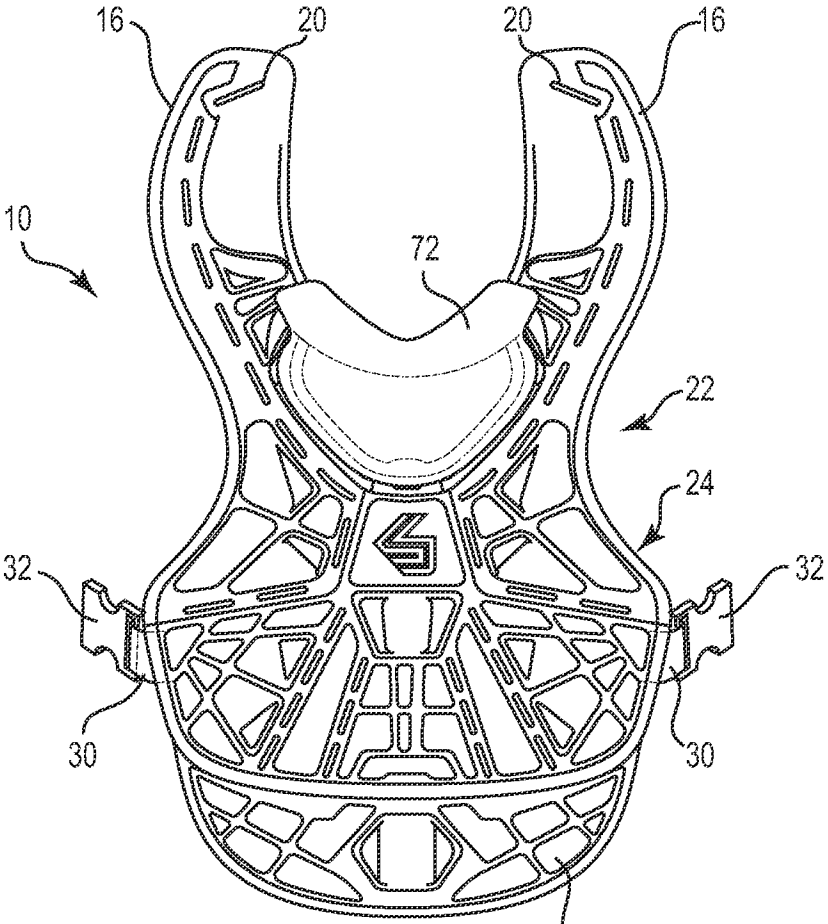
FIG. 7 illustrates the front extension of a neck brace engaged in the front protective assembly in accordance with embodiments of the present invention.

Once the chest pad 26 has been removed from the chest pad receiving region 80, the front protective assembly 10 is ready to accommodate the front extension 72 of the neck brace 60. Similarly, once a spine pad (if present) has been removed from the spine pad receiving region 46 of the rear protective assembly 40, the rear protective assembly 40 is configured to accommodate the rear extension 76 of the neck brace 60. In FIGS. 5 and 6, the front and rear extensions 72, 76 can be seen moving down into position, such as if the wearer is in the process of lowering the neck brace 60 into position relative to the front protective assembly 10 and the rear protective assembly 40. In FIGS. 7 and 8, the front extension 72 can be seen nested into the chest pad receiving region 80 and the rear extension 76 can be seen nested into the spine pad receiving region 46. In some embodiments, as illustrated in FIG. 10, a spine pad 120 may be removably secured within the spine pad receiving region 46 when no neck brace is being used.

Figure 9:
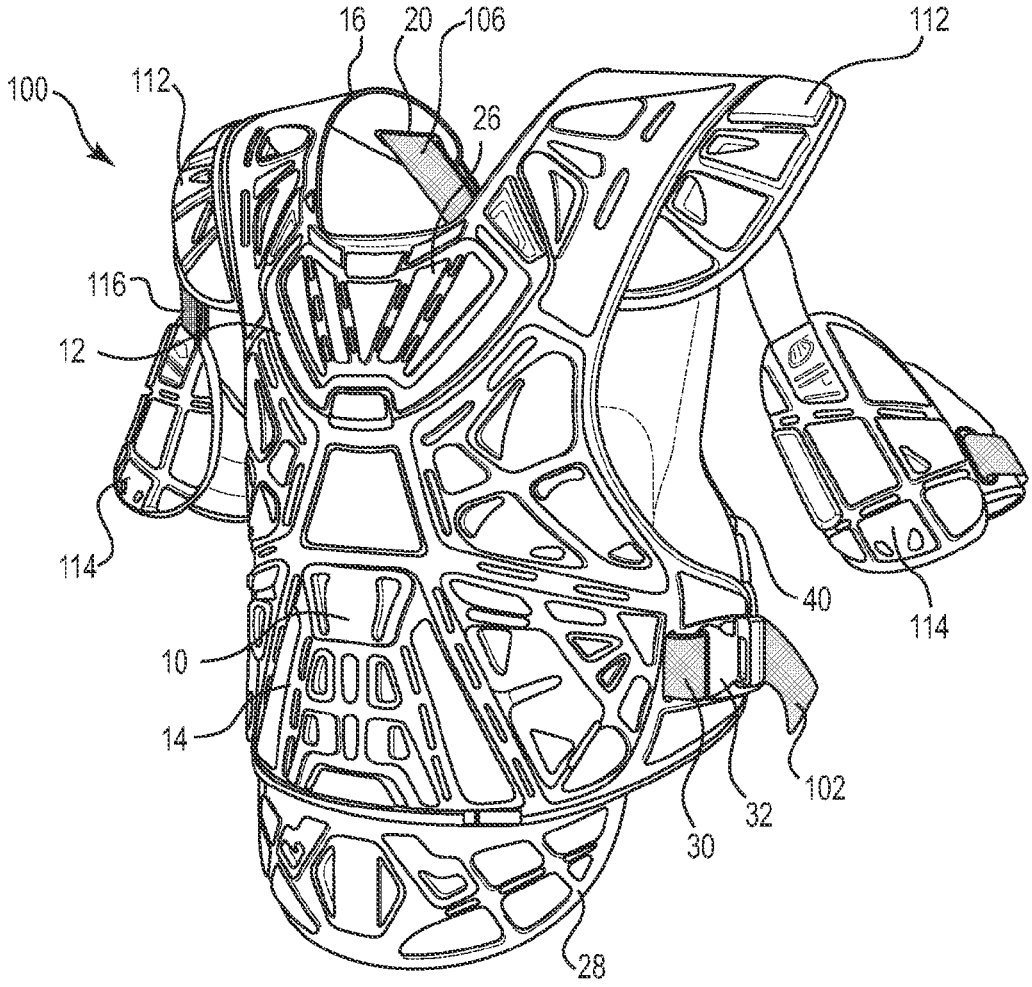
FIG. 9 illustrates a front view of an impact protection device in accordance with embodiments of the present invention.
Figure 10:
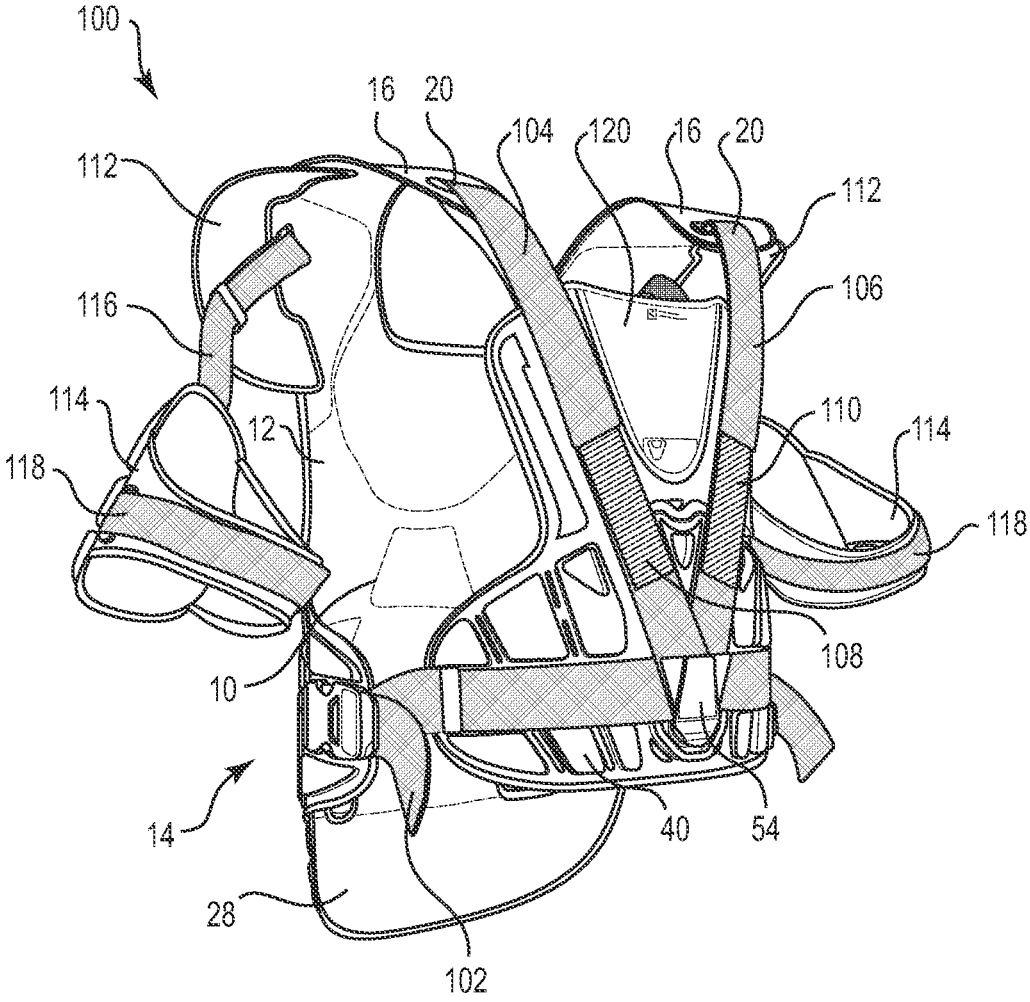
FIG. 10 illustrates a rear view of an impact protection device in accordance with embodiments of the present invention.

FIGS. 9 and 10 provide front and rear illustrations, respectively, of an impact protection device 100 that combines the front protective assembly 10, the rear protective assembly 40, the straps that secure the front protective assembly 10 to the rear protective assembly 40, as well as optional components. The front protective assembly 10 and the rear protective assembly 40 are secured together by a strap 102 that extends along or through the strap track 48 and is attached at either end to the buckles 32. It will be appreciated that the buckles 32 permit adjustment to accommodate an individual wearer's physique.

The front protective assembly 10 and the rear protective assembly 40 are also, in some embodiments, secured together via straps 104 and 106 that extend along or through the strap tracks 50. In some embodiments, the straps 104 and 106 are secured to the rear protective assembly 40 at anchor location 54 and then extend upwardly through the slots 20 formed within the extensions 16 of the front protective assembly 10. The straps 104 and 106 may be secured to themselves via a hook-and-loop fastener system. In some embodiments, the straps 104 and 106 may each include a fastener region 108 and 110, respectively. One half of a hook-and-loop fastener system may be disposed on the back side (not visible) of the straps 104 and 106, and the other half of the system may be provided within the fastener regions 108 and 110. It will be appreciated that this system provides secure attachment of the front protective assembly 10 to the rear protective assembly 40 while accommodating a variety of physiques.

In some embodiments, the impact protection device 100 may include any of a variety of different optional components. While a variety of different optional components are available, as discussed above, the illustrated embodiment merely shows a couple components. In some embodiments, the impact protection device 100 may, for example, include shoulder extensions 112. In some embodiments, the shoulder extensions 112 may be releasably secured to the extensions 16 of the shoulder region 12 and may be attached via a hook-and-loop fastener system. It is contemplated that the shoulder extensions 112 could be formed as an integral part of the shoulder region 12 of the front protective assembly 10.

Another illustrative but non-limiting example of a suitable optional component are the biceps pads 114. In some embodiments, the biceps pads 114 include an attachment strap 116 via which the biceps pads 114 may be releasably secured to the shoulder extensions 112. The biceps pads 114 may also include an adjustment strap 118 that may be used to alter an effective diameter of the biceps pads 114 in order to accommodate a variety of physiques.

Various modifications and additions can be made to the exemplary embodiments discussed. For example, while the embodiments described above refer to particular features, the scope of this invention also includes embodiments having different combinations of features and embodiments that do not include all of the described features. Accordingly, the scope of the disclosure is intended to embrace all such alternatives, modifications, and variations as fall within the scope of the disclosure, together with all equivalents thereof.

We claim:

1. An impact protection device configured for optional use with a neck brace including a front extension, the front extension having a shape defined by a first side edge extending downward and a second side edge extending downward opposite the first side edge, the first and second side edges diverging away from one another in a downward direction, a third side edge extending from the first side edge and a fourth side edge extending downwardly from the second side edge opposite the third side edge, the third and fourth side edges converging toward one another in a downward direction, and an arcuate bottom edge extending between the third and fourth side edges, the impact protection device comprising:

a front protective assembly including a shoulder region configured to extend over a wearer's clavicles or shoulders and a chest region configured to extend over the wearer's ribcage;

a chest pad receiving region disposed within the chest region at a location corresponding to where the front extension of the neck brace would nest when the neck brace is used, the chest pad receiving region having a shape that corresponds to the shape of the front extension of the neck brace;

a rear protective assembly; and a chest pad removably secured within the chest pad receiving region, the chest pad having a shape that corresponds to the shape of the front extension of the neck brace such that the front extension of the neck brace fits into the chest pad receiving region when the chest pad is removed and the chest pad fits within the chest pad receiving region when the wearer chooses not to use the neck brace.

2. The impact protection device of claim 1, wherein the front protective assembly and the rear protective assembly are each formed of a resilient material.

3. The impact protection device of claim 1, wherein the front protective assembly and the rear protective assembly each comprise foam.

4. The impact protection device of claim 1, wherein the rear protective assembly includes a rear channel that is configured to accommodate a rear extension of a neck brace.

5. The impact protection device of claim 4, further comprising a spine pad removably securable within the rear channel.

6. The impact protection device of claim 1, wherein the chest pad is removably secured to the chest pad receiving region with hook and loop fasteners.

7. The impact protection device of claim 1, wherein the chest pad receiving region comprises a void formed in the front protective assembly, the void shaped to accommodate the chest pad.

8. The impact protection device of claim 1, wherein the front protective assembly is patterned to provide for air circulation through the front protective assembly.

9. The impact protection device of claim 8, wherein the front protective assembly includes an air-permeable base fabric layer and a patterned foam layer secured to the base fabric layer.

10. The impact protection device of claim 1, further comprising one or more straps extending between the front protective assembly and the rear protective assembly in order to secure the impact protection device about the wearer.

11. The impact protection device of claim 1, further comprising one or more straps extending between a lower region of the front protective assembly and a lower region of the rear protective assembly, the one or more straps extending around the wearer's midsection.

12. The impact protection device of claim 11, wherein the one or more straps comprise a buckle for adjusting a length of the one or more straps.

13. The impact protection device of claim 1, further comprising one or more straps extending from the shoulder region of the front protective assembly and an upper region of the rear protective assembly, the one or more straps extending over the wearer's shoulders.

14. The impact protection device of claim 13, wherein the one or more straps loop through an aperture formed in the shoulder region of the front protective assembly and releasably attaches to the rear protective assembly.

15. The impact protection device of claim 1, further comprising an abdominal pad removably secured to a lower side of the front protective assembly.

16. The impact protection device of claim 1, further comprising one or more of shoulder extensions and biceps pads releasably secured to the impact protection device.

17. An impact protection device configured for optional use with a neck brace having a rear extension, the impact protection device comprising:

a front protective assembly including a shoulder region configured to extend over a wearer's clavicles or shoulders and a chest region configured to extend over the wearer's ribcage, the front protective assembly defining a chest pad receiving region disposed within the chest region;

a chest pad removably secured within the chest pad receiving region;

a rear protective assembly including a spine pad receiving region at a location corresponding to where the rear extension of the neck brace would nest when the neck brace is used, the spine pad receiving region having a shape that corresponds to a shape of the rear extension of the neck brace;

a spine pad removably secured within the spine pad receiving region, the spine pad having a shape that corresponds to a shape of the rear extension of the neck brace such that the rear extension fits into the spine pad receiving region when the spine pad is removed and the spine pad fits within the spine pad receiving region when the neck brace is not used.

18. The impact protection device of claim 17, wherein the chest pad and the spine pad are configured to be kept in place when the wearer chooses not to use a neck brace.

19. The impact protection device of claim 17, wherein the front protective assembly includes an air-permeable base fabric layer and a patterned foam layer secured to the base fabric layer, the patterned foam layer configured to permit air circulation through the front protective assembly.

20. An impact protection assembly comprising:

a neck brace including a front extension and a rear extension;

a front protective assembly including a shoulder region configured to extend over a wearer's clavicles or shoulders and a chest region configured to extend over the wearer's ribcage, the front protective assembly defining a chest pad receiving region disposed within the chest region, the chest pad receiving region configured to releasably secure a chest pad within the chest pad receiving region, the chest pad and chest pad receiving region each having a shape that corresponds to a shape of the front extension of the neck brace such that the front extension of the neck brace nests into the chest pad receiving region in the absence of the chest pad;

a rear protective assembly including a spine pad receiving region, the spine pad receiving region configured to releasably secure a spine pad within the spine pad receiving region, the spine pad and spine pad receiving region each having a shape that corresponds to a shape of the rear extension of the neck brace such that the rear extension of the neck brace nests into the spine pad receiving region in the absence of the spine pad; and one or more straps that extend between the front protective assembly and the rear protective assembly to secure the front protective assembly to the rear protective assembly.

21. The impact protection device of claim 1, wherein the chest pad removably secured within the chest pad receiving region includes a substantially arcuate top edge, a first side edge extending from the top edge and a second side edge extending from the top edge opposite the first side edge, the first and second side edges diverging away from one another in a downward direction, a third side edge extending from the first side edge and a fourth side edge extending downwardly from the second side edge opposite the third side edge, the third and fourth side edges converging toward one another in a downward direction, and a bottom edge extending between the third and fourth side edges that is substantially flat.

* * * * *